US006657401B2

(12) United States Patent
Kominami et al.

(10) Patent No.: US 6,657,401 B2
(45) Date of Patent: Dec. 2, 2003

(54) BALLAST FOR DISCHARGE LAMP

(75) Inventors: Satoshi Kominami, Katano (JP); Kenichirou Takahashi, Katano (JP); Masayoshi Gyoten, Otsu (JP); Koji Miyazaki, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/893,105

(22) Filed: Jun. 27, 2001

(65) Prior Publication Data

US 2002/0047645 A1 Apr. 25, 2002

(30) Foreign Application Priority Data

Jun. 28, 2000 (JP) ..... 2000-194649

(51) Int. Cl.[7] ..... G05F 1/00

(52) U.S. Cl. ..... 315/291; 315/DIG. 4; 315/307

(58) Field of Search ..... 315/DIG. 4, 209 R, 315/200 R, 217, 224, 225, 291, 307, DIG. 5, DIG. 7; G05F 1/00

(56) References Cited

U.S. PATENT DOCUMENTS 5,493,181 A * 2/1996 Shackle et al. ..... 315/209 R
5,493,182 A * 2/1996 Sowa et al. ..... 315/291
5,615,093 A * 3/1997 Nalbant ..... 315/307
5,994,848 A * 11/1999 Janczak ..... 315/224
6,188,553 B1 * 2/2001 Moisin ..... 315/127
6,337,800 B1 * 1/2002 Chang ..... 315/209 R

FOREIGN PATENT DOCUMENTS

| | | | |
|---|---|---|---|
| GB | 2 052 896 | 1/1981 | ..... H05B/41/14 |
| GB | 2 319 406 | 5/1998 | ..... H05B/41/38 |
| JP | 5-62785 | 3/1993 | ..... H05B/41/24 |
| JP | 6-223991 | 8/1994 | ..... H05B/41/36 |
| JP | 11-111486 | 4/1999 | ..... H05B/41/392 |

* cited by examiner

*Primary Examiner*—Don Wong
*Assistant Examiner*—Trinh Vo Dinh
(74) *Attorney, Agent, or Firm*—Merchant & Gould P.C.

(57) ABSTRACT

A ballast for a discharge lamp includes a fluorescent lamp, an AC/DC conversion portion, a dimming control portion, and a DC/AC conversion portion. The AC/DC conversion portion converts a phase-controlled input AC voltage to a DC voltage. The dimming control portion calculates a dimming control signal from the input AC voltage. The DC/AC conversion portion converts the DC voltage from the AC/DC conversion portion to a high frequency AC voltage to be applied to the fluorescent lamp and lights and dims the lamp in response to the dimming control signal. The DC/AC conversion portion has a first operation mode for maintaining the lighting of the fluorescent lamp and for lighting and dimming the same and a second operation mode for supplying the fluorescent lamp with a voltage lower than the starting voltage of the lamp in its non-operating state. The conducting period of the phase-controlled AC voltage can be detected even in the non-operating state of the fluorescent lamp so as to restart the lamp.

7 Claims, 6 Drawing Sheets

BALLAST FOR DISCHARGE LAMP

BACKGROUND OF THE INVENTION

1. Field of the Invention

The present invention relates to a ballast for a discharge lamp that is supplied with a phase-controlled AC voltage to light and dim a discharge lamp, in particular, a fluorescent lamp.

2. Description of the Related Art

Compared with an incandescent lamp, a fluorescent lamp has an advantageous feature of high efficiency and long life, so that it has been widely used, for example, in household lighting fixtures. In particular, the requirement to save energy and resources increases the demand for a bulb-shaped fluorescent lamp, in which a fluorescent lamp is integrated with a high frequency inverter, because the lamp can be inserted in an incandescent-lamp socket without modifying the socket.

In recent years, with the growing need for dimming a bulb-shaped fluorescent lamp like an incandescent lamp, a dimmable bulb-shaped fluorescent lamp has been under development. In the case of an incandescent lamp, a dimmer is used generally to supply a phase-controlled AC voltage for dimming. Therefore, to achieve the dimming of a bulb-shaped fluorescent lamp, it is necessary for a ballast circuit to be supplied with a phase-changed AC voltage so that the fluorescent lamp can be lit and dimmed. JP 11(1999)-111486 A discloses an example of a ballast for a discharge lamp that is supplied with a phase-controlled AC voltage to light and dim a fluorescent lamp. The ballast circuit of JP 11-111486 A includes a detection portion for detecting the conducting period of a phase-controlled AC voltage input and changes the brightness of the fluorescent lamp according to the detected conducting period.

In the above conventional ballast, when the fluorescent lamp is off, only a power smoothing capacitor in the ballast circuit is connected equivalently to a dimmer. Thus, the load characteristics become capacitive, causing malfunction of the dimmer. This makes the output waveform of the dimmer unstable, i.e., the waveform is different from a phase-controlled voltage waveform, as indicated by an example shown in FIGS. 6A and 6B. Specifically, when the fluorescent lamp having the waveform in FIG. 6A is dimmed increasingly during operation to be turned off for a while, it provides the waveform in FIG. 6B. As a result, the precise conducting period of a phase-controlled AC voltage cannot be detected. Therefore, when the fluorescent lamp in its non-operating state is started by adjusting the dimmer, it is impossible to restart the lamp according to the conducting period. Moreover, the ballast circuit malfunctions, causing problems such as flickering of the fluorescent lamp.

SUMMARY OF THE INVENTION

Therefore, with the foregoing in mind, it is an object of the present invention to provide a ballast for a discharge lamp that is supplied with a phase-controlled AC voltage to light and dim a fluorescent lamp, the ballast being capable of detecting the conducting period of the phase-controlled AC voltage even in the non-operating state of the fluorescent lamp, restarting the lamp according to the conducting period, and preventing malfunction of a ballast circuit, such as flickering of the lamp.

To solve the above problems, a ballast for discharge lamp of the present invention includes a discharge lamp, an AC/DC conversion portion, a dimming control portion, and a DC/AC conversion portion. The AC/DC conversion portion converts a phase-controlled input AC voltage to a DC voltage. The dimming control portion calculates a dimming control signal from the phase-controlled input AC voltage. The DC/AC conversion portion converts an output voltage of the AC/DC conversion portion to a high frequency voltage to be applied to the discharge lamp and lights and dims the discharge lamp in response to the dimming control signal. The DC/AC conversion portion has a first operation mode that supplies the discharge lamp with a voltage for maintaining the lighting and a second operation mode that supplies the discharge lamp with a voltage lower than a starting voltage of the discharge lamp in its non-operating state.

This configuration can detect the conducting period of a phase-controlled AC voltage even when the fluorescent lamp is off, allowing the lamp to be restarted according to the conducting period. Also, the fluorescent lamp is supplied with a voltage lower than the starting voltage of the lamp in its non-operating state, preventing the lamp from flickering.

In the above configuration, the DC/AC conversion portion may switch the first and second operation modes in response to the dimming control signal.

It is preferable that the above configuration further includes a lamp characteristic detection portion for detecting the lamp characteristics of the discharge lamp, and that the DC/AC conversion portion switches from the first operation mode to the second operation mode in response to an output signal of the lamp characteristic detection portion. For example, the lamp characteristic detection portion detects the operating/non-operating state of the fluorescent lamp, and thus the first operation mode is switched to the second operation mode, which can prevent the ballast circuit failure. In this configuration, the lamp characteristic detection portion may detect at least a factor selected from a lamp voltage, lamp current, lamp power, and optical output as the lamp characteristics.

In any one of the above configurations, the DC/AC conversion portion may perform lighting and dimming by changing a driving frequency. In this case, f2 may be greater than f1, where f1 is a maximum driving frequency of the DC/AC conversion portion in the first operation mode and f2 is a driving frequency of the DC/AC conversion portion in the second operation mode.

A bulb-shaped fluorescent lamp may include a base and the ballast in any one of the above configurations, where the AC/DC conversion portion, the dimming control portion, the DC/AC conversion portion, and the discharge lamp are formed integrally.

BRIEF DESCRIPTION OF THE DRAWINGS

FIG. 6A is a waveform diagram showing an output voltage from a dimmer when a conventional fluorescent lamp is on.

DESCRIPTION OF THE PREFERRED EMBODIMENTS

First Embodiment

Figure 1:
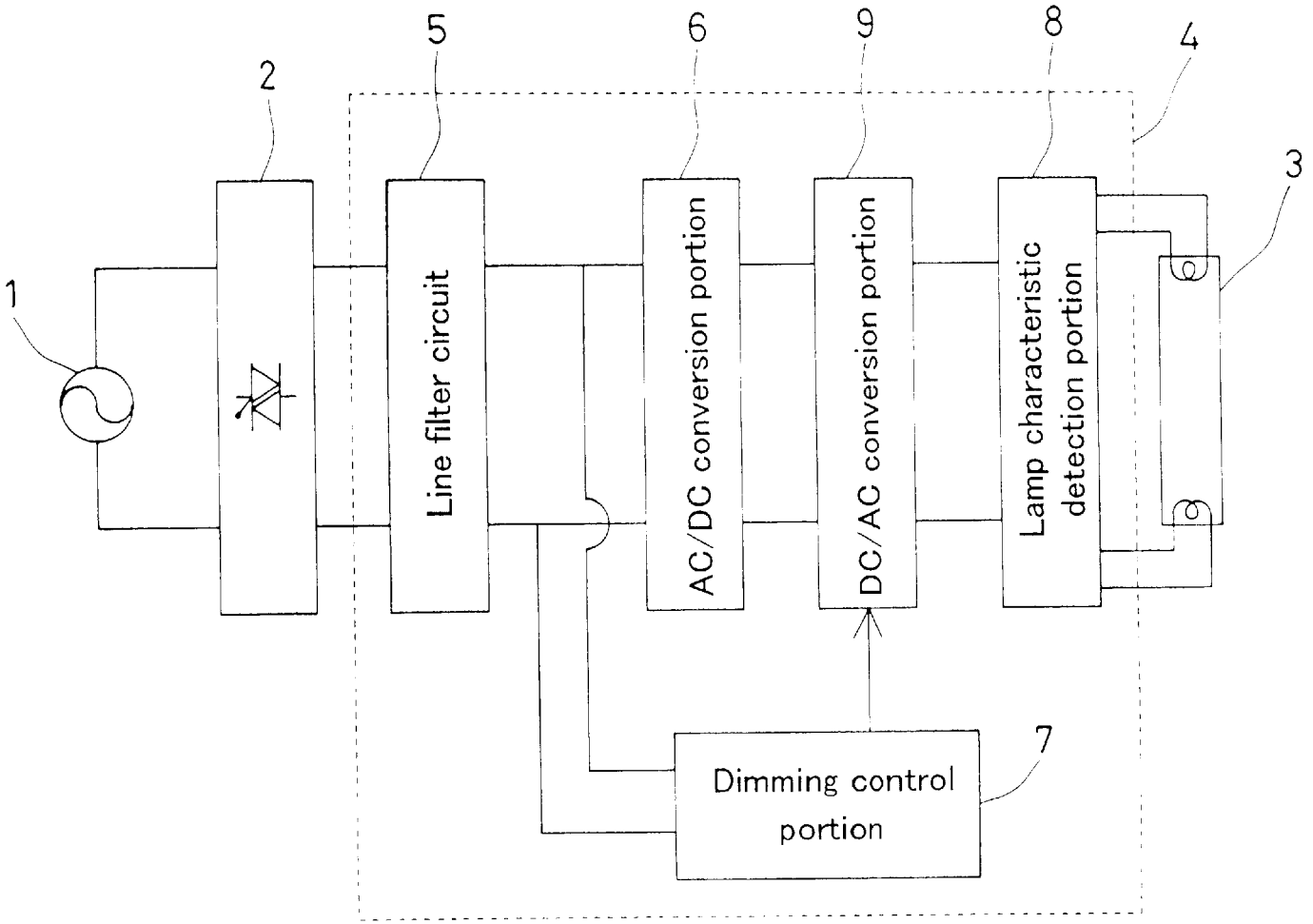
FIG. 1 shows the configuration of a ballast for a discharge lamp according to a first embodiment of the present invention.

FIG. 1 shows the configuration of a ballast for a discharge lamp according to a first embodiment of the present invention. Numeral 1 is an AC power source that supplies an AC voltage, e.g., a 60 Hz, 100 V power source. Numeral 2 is a dimmer that controls the phase of the AC power source 1. Well-known devices including a triac or the like are used as the dimmer 2. Numeral 3 is a fluorescent lamp, i.e., a discharge lamp, and 4 is a ballast circuit that supplies power to light the fluorescent lamp 3.

The ballast circuit 4 includes a line filter circuit 5, an AC/DC conversion portion 6, a dimming control portion 7, a DC/AC conversion portion 9, and a lamp characteristic detection portion 8. The line filter circuit 5 includes an inductor, a capacitor, or the like, and prevents high frequency noise from entering the AC power source 1. The AC/DC conversion portion 6 is an element for converting a phase-controlled AC voltage output from the dimmer 2 to a DC voltage. The AC/DC conversion portion 6 includes a rectifier circuit, a smoothing capacitor, or the like, so that the AC voltage input through the line filter circuit 5 is rectified and smoothed into a DC voltage. The dimming control portion 7 calculates a dimming control signal from the phase-controlled AC voltage. The DC/AC conversion portion 9 converts the DC voltage from the AC/DC conversion portion 6 to a high frequency voltage and lights and dims the fluorescent lamp 3 in response to the dimming control signal from the dimming control portion 7. The DC/AC conversion portion 9 has a first operation mode and a second operation mode: the first operation mode supplies the fluorescent lamp 3 with a voltage for maintaining the lighting; the second operation mode supplies the fluorescent lamp 3 with a voltage lower than the starting voltage of the lamp in its non-operating state. The lamp characteristic detection portion 8 detects the lamp characteristics of the fluorescent lamp 3.

Figure 2:
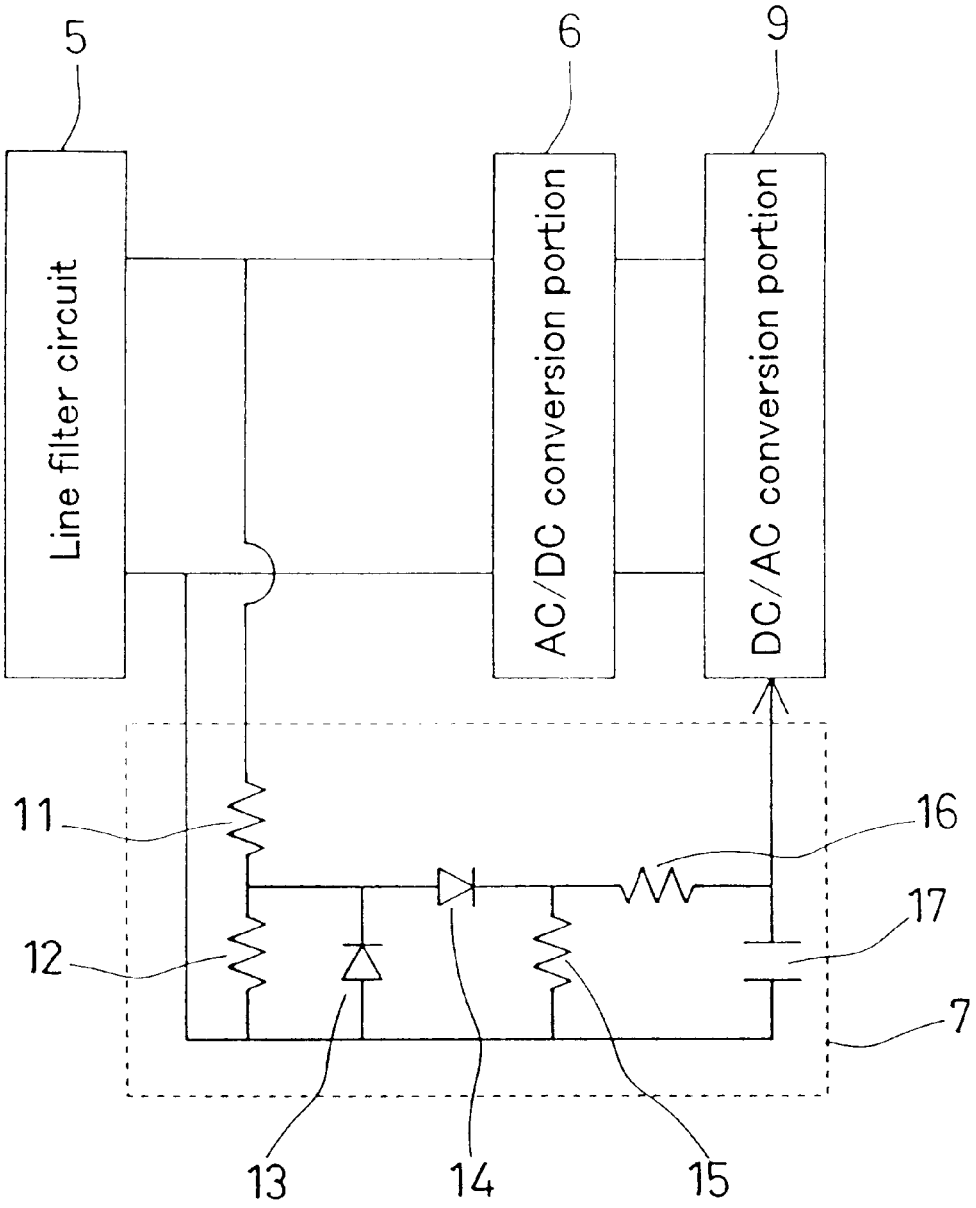
FIG. 2 is a circuit diagram showing an example of a dimming control portion in FIG. 1.
Figure 3:
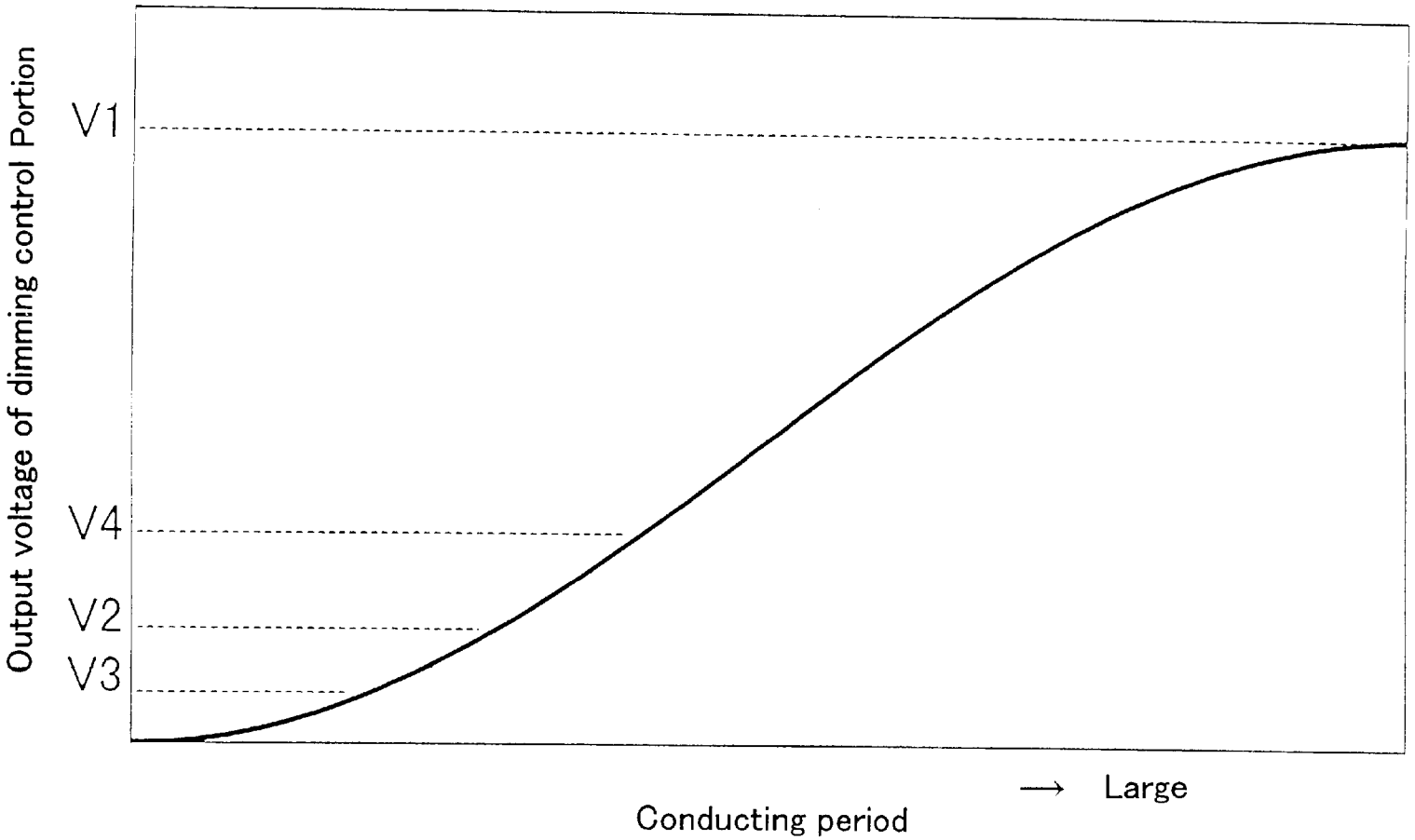
FIG. 3 shows an example of a dimming control signal from the dimming control portion in FIG. 2.

FIG. 2 shows an example of the dimming control portion 7. The dimming control portion 7 includes resistors 11, 12, 15, and 16, diodes 13 and 14, and a capacitor 17. The phase-controlled AC voltage input is divided and rectified by the resistors 11, 12 and the diode 13, which then is smoothed by the capacitor 17 via the diode 14 and the resistor 16. The voltage of the capacitor 17 corresponds to the conducting period of the phase-controlled AC voltage and is supplied to the DC/AC conversion portion 9 as a dimming control signal. Since a user can set the conducting period of the phase-controlled AC voltage arbitrarily with the dimmer 2, the dimming control signal is changed according to the conducting period, as shown in FIG. 3. For example, the dimming control signal gives instructions to light 100% at the output voltage V1 and 10% at the output voltage V2. When the dimming control signal is V3 during the first operation mode, it instructs the DC/AC conversion portion 9 to switch to the second operation mode. When the dimming control signal is V4 during the second operation mode, it instructs the same to switch to the first operation mode. The definition of the first and second operation modes will be described later. The resistor 15 is used for discharging the capacitor 17.

The lamp characteristic detection portion 8 in FIG. 1 outputs a signal showing that the fluorescent lamp 3 has been turned off unusually, i.e., a signal giving instructions to switch from the first to the second operation mode, to the DC/AC conversion portion 9. The judgment whether the fluorescent lamp 3 should be turned on or off can be made, e.g., by detecting a lamp voltage, lamp current, lamp power, or optical output. The lamp voltage can be detected, e.g., by inserting a resistor in parallel with the fluorescent lamp 3. The lamp current can be detected, e.g., by inserting a resistor in series with the fluorescent lamp 3. The lamp power can be detected, e.g., by detecting the lamp voltage and the lamp current to be calculated with a multiplying circuit. The optical output can be detected, e.g., by a photodiode or the like. The signal that instructs the switching to the second operation mode is output from the lamp characteristic detection portion 8 when the fluorescent lamp 3 is turned off unusually. The unusual turning-off of the lamp can be detected, e.g., by combining the output conditions of the DC/AC conversion portion 9 with the detection of turning-off of the fluorescent lamp 3. Specifically, when the lamp characteristic detection portion 8 detects the turning-off of the fluorescent lamp 3 while receiving the output from the DC/AC conversion portion 9 in the first operation mode, it is taken as the unusual turning-off of the lamp. Based on the detection, the lamp characteristic detection portion 8 outputs a signal that instructs the switching to the second operation mode.

Figure 4:
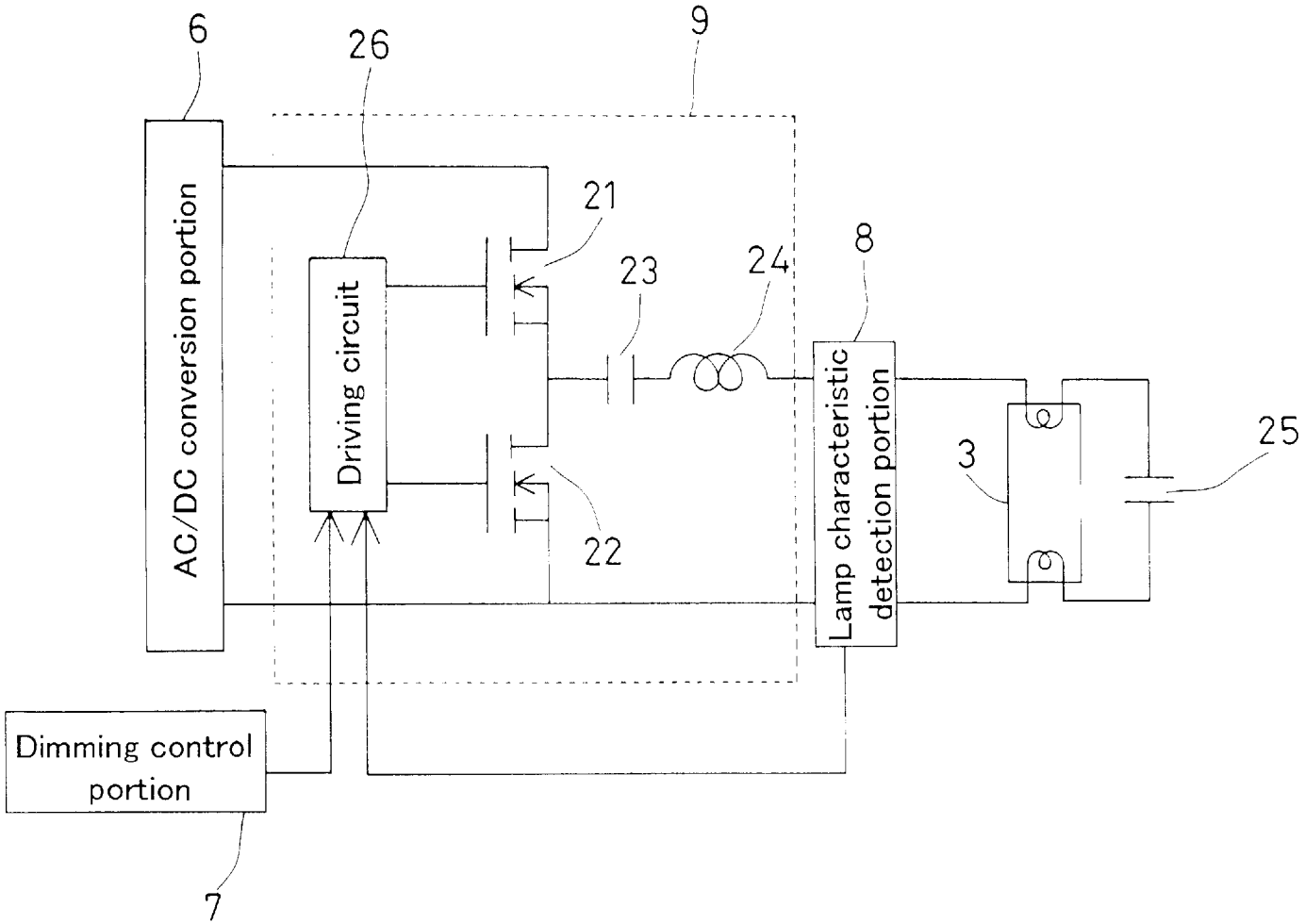
FIG. 4 is a circuit diagram showing an example of a DC/AC conversion portion in FIG. 1.

FIG. 4 shows an example of the DC/AC conversion portion 9. Referring to FIG. 4, numeral 21, 22 are switching devices, 23 is a capacitor for interrupting a DC component, 24 is a choke coil for limiting the lamp current through the fluorescent lamp 3, 25 is a capacitor for preheating an electrode of the fluorescent lamp 3 and for generating a resonance voltage across the lamp, and 26 is a driving circuit for driving the switching devices 21, 22. The DC/AC conversion portion 9 converts a DC voltage from the AC/DC conversion portion 6 to a high frequency voltage by causing the switching devices 21, 22 to alternate between on and off, and then applies the high frequency voltage to the fluorescent lamp 3 via a resonant circuit, which includes the choke coil 24 and the capacitors 23, 25. The driving circuit 26 switches the first and second operation modes in response to a dimming control signal from the dimming control portion 7 and a signal from the lamp characteristic detection portion 8. When the signal from the lamp characteristic detection portion 8 indicates the second operation mode, it has priority over the dimming control signal.

In the first operation mode, the driving circuit 26 drives the switching devices 21, 22, e.g., at 50 kHz to 70 kHz in response to the dimming control signal from the dimming control portion 7. In the second operation mode, it drives the switching devices 21, 22, e.g., at 100 kHz. These driving frequencies are set so as to satisfy the following: in the first operation mode, the fluorescent lamp 3 is supplied with a voltage large enough to light and dim the lamp; in the second operation mode, the fluorescent lamp 3 is supplied with a voltage sufficiently lower than the starting voltage of the lamp in its non-operating state.

The operation of a ballast for a discharge lamp having the above configuration will be described.

The first operation mode is described below. The fluorescent lamp 3 maintains the lighting by the application of a high frequency voltage from the DC/AC conversion portion 9. The DC/AC conversion portion 9 performs dimming by changing a driving frequency based on a dimming control signal from the dimming control portion 7. The level of the optical output of the fluorescent lamp 3 depends on the driving frequency of the DC/AC conversion portion 9.

Specifically, the optical output level increases with decreasing driving frequency, while it decreases with increasing driving frequency. For one example, the lamp provides the maximum brightness at 50 kHz, and the minimum brightness at 70 kHz. This is because the impedance of a load network, including the fluorescent lamp 3, the capacitors 23, 25, and the choke coil 24, changes with the driving frequency, which leads to a change in current through the fluorescent lamp 3.

When the level of the dimming control signal from the dimming control portion 7 becomes V3 by operating the dimmer 2 while the DC/AC conversion portion 9 operates in the first operation mode, the first operation mode is switched to the second operation mode. Upon switching to the second operation mode, the driving frequency is raised to 100 kHz, causing a sharp reduction in the amount of current through the fluorescent lamp 3. Thus, the lamp cannot maintain the discharge and stops its operation. However, the DC/AC conversion portion 9 continues to operate, and a low voltage, e.g., about 100 V, is generated in the capacitor 25 to such an extent that the fluorescent lamp 3 does not start. Although the fluorescent lamp 3 is turned off, the DC/AC conversion portion 9 continues to operate. Therefore, the load characteristics viewed from the dimmer 2 are different from the capacitive of a conventional lamp, so that the dimmer 2 operates normally. In other words, since the dimmer 2 operates normally even when the fluorescent lamp 3 is off, the precise conducting period of a phase-controlled AC voltage can be detected. Moreover, a voltage of about 100 V, which is lower than the starting voltage of the fluorescent lamp 3, always is generated in the capacitor 25. Thus, the malfunction of the ballast circuit 4, such as flickering of the fluorescent lamp 3, does not occur.

On the other hand, when the level of the dimming control signal from the dimming control portion 7 becomes V4 by operating the dimmer 2 while the DC/AC conversion portion 9 operates in the second operation mode, the second operation mode is switched to the first operation mode. Upon switching to the first operation mode, the driving frequency is reduced from 100 kHz, which results in the generation of a high voltage in the capacitor 25, and thus the fluorescent lamp 3 is restarted. Thereafter, the DC/AC conversion portion 9 lights and dims the fluorescent lamp 3 in response to a signal from the dimming control portion 7.

When the ambient temperature is low, in particular, under a high degree of dimming, the fluorescent lamp 3 may discontinue lighting because the lamp temperature is not raised due to a lack of self-heating. Also, there are some cases where the fluorescent lamp 3 does not start in the last period of the lamp life or the like. In such cases, the lamp characteristic detection portion 8 detects the operating/non-operating state of the fluorescent lamp 3 and causes the DC/AC conversion portion 9 to operate in the second operation mode, thus preventing the failure of the ballast circuit 4.

As described above, the first embodiment provides the DC/AC conversion portion 9 that has the first and second operation modes and switches the two operation modes in response to a dimming control signal from the dimming control portion 7. In the first operation mode, the DC/AC conversion portion 9 drives at the driving frequency of 50 kHz to 70 kHz to light and dim the fluorescent lamp 3; in the second operation mode, it drives at 100 kHz to apply a voltage of 100 V to the fluorescent lamp 3 in its non-operating state. Thus, the conducting period of a phase-controlled AC voltage can be detected even in the non-operating state of the fluorescent lamp 3, so that the lamp can be turned off and restarted according to the conducting period.

Since the fluorescent lamp 3 is supplied with a voltage of 100 V lower than the starting voltage of the lamp in its non-operating state, the flickering of the lamp can be eliminated. In addition, the lamp characteristic detection portion 8 detects the operating/non-operating state of the fluorescent lamp 3 and causes switching from the first to the second operation mode, thus preventing the failure of the ballast circuit 4.

Second Embodiment

Figure 5:
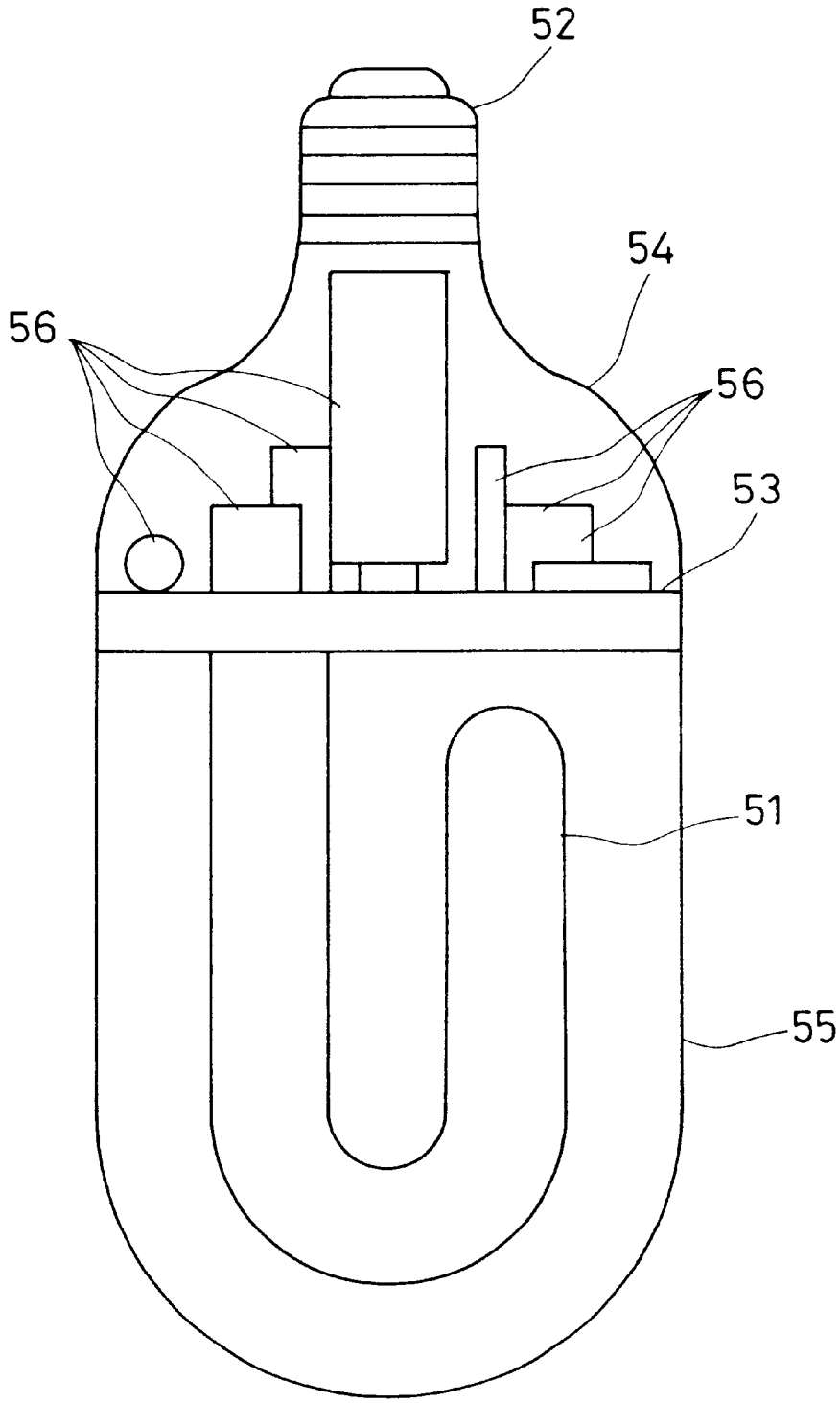
FIG. 5 is a perspective diagram showing a bulb-shaped fluorescent lamp according to a second embodiment of the present invention.
Figure 6A:
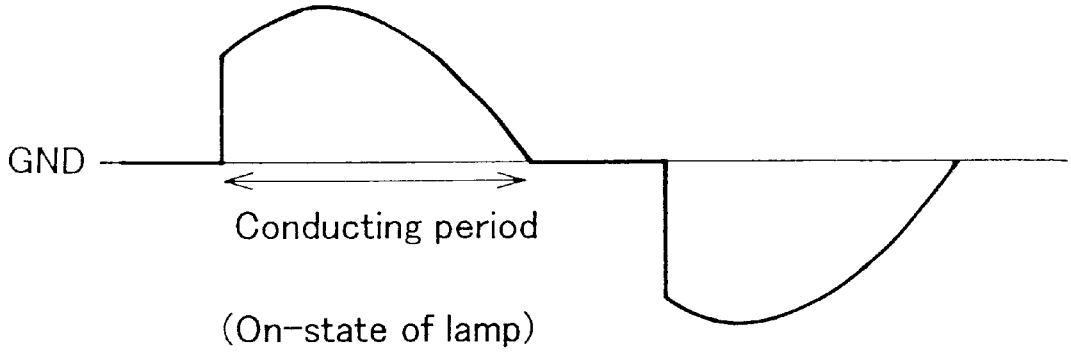
FIG. 6A (PRIOR ART)
Figure 6B:
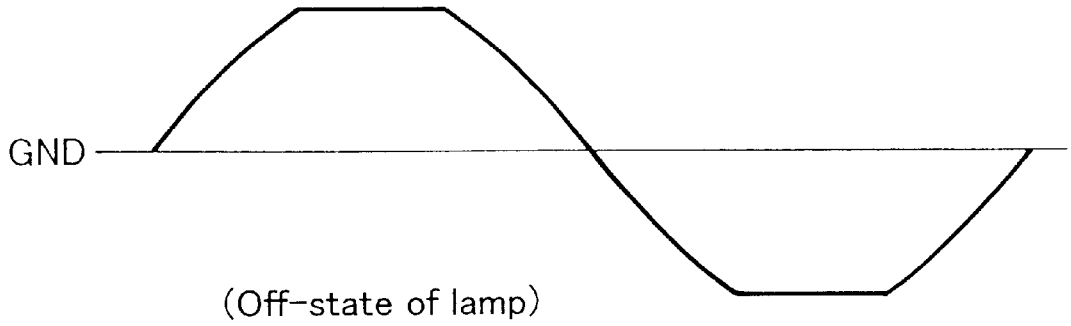
FIG. 6B (PRIOR ART)
FIG. 6B is a waveform diagram showing an output voltage from a dimmer when a conventional fluorescent lamp is off.

FIG. 5 shows the configuration of a ballast for a discharge lamp according to a second embodiment of the present invention. Referring to FIG. 5, numeral 51 is a bent fluorescent lamp, i.e., a discharge lamp, 52 is a base for an incandescent lamp, such as E26-type or the like, 53 is a circuit board, 54 is a cover, and 55 is a transparent globe. The circuit board 53 is provided with circuit components 56 that constitute the same ballast as that in the first embodiment shown in FIG. 1. The cover 54 has the base 52 at one end and houses the circuit board 53. The globe 55 is arranged so as to cover the periphery of the fluorescent lamp 51.

The fluorescent lamp 51 and the circuit board 53, and the circuit board 53 and the base 52 are connected electrically with each other, though the connections are not shown. The ballast is screwed into an incandescent lamp socket so that power is supplied via the base 52 to light the fluorescent lamp 51. The voltage input via the base 52 is an AC voltage whose phase is controlled by an external phase-control device, e.g., a dimmer for an incandescent lamp or the like. Each of the circuit components 56 is attached to the circuit board 53, and only the typical components are illustrated here. Like the first embodiment, the ballast of this embodiment can detect the conducting period of a phase-controlled AC voltage even in the non-operating state of the fluorescent lamp. Thus, the fluorescent lamp can be turned off and restarted according to the conducting period, and the malfunction of a ballast circuit that causes flickering of the lamp can be prevented.

As described above, the second embodiment can provide stable lighting and dimming even when an incandescent lamp is replaced by a fluorescent lamp.

In the first embodiment, the commercial power source has been explained as a 60 Hz, 100 V power source. However, it should be noted that the present invention can be applied to a power source with different frequency and voltage, such as 50 Hz and 100 V. There is no particular limitation to the AC/DC conversion portion 6, as long as it is supplied with a phase-controlled AC voltage and converts the voltage to a DC voltage. Therefore, a well-known configuration may be employed, which includes, e.g., an active filter circuit using a step-up chopper, a partial smoothing circuit for feeding back a part of the voltage from the DC/AC conversion portion 9, and the like. The dimming control portion 7 is not limited to the configuration shown in FIG. 2, and other configurations, e.g., for outputting a pulse voltage corresponding to the conducting period, may be employed. At least the dimming control portion 7 is required to have a configuration that can calculate a dimming control signal from the phase-controlled AC voltage. The DC/AC conversion portion 9 is not limited to a series inverter, and other configurations, e.g., a half bridge inverter or the like, may be employed. At least the DC/AC conversion portion 9 is required to have a configuration that can convert a DC voltage from the AC/DC conversion portion 6 to a high frequency AC voltage so as to light and dim the fluorescent lamp 3.

It should be noted that the driving frequency of 50 kHz to 70 kHz of the DC/AC conversion portion 9 in the first operation mode changes depending on constants of the choke coil 24 and the capacitors 23, 25 that are included in a load network. The DC/AC conversion portion 9 may drive at other frequencies, as long as the fluorescent lamp 3 can be lit and dimmed. Similarly, the driving frequency of 100 kHz in the second operation mode changes depending on the constants of the load network, and the DC/AC conversion portion 9 may drive at other frequencies, as long as the fluorescent lamp 3 in its non-operating state can be supplied with a voltage of 100V. The voltage applied to the fluorescent lamp 3 in the second operation mode is set to 100 V in the above description. However, the present invention is not limited thereto, and a larger voltage, e.g., 200 V, may be applied, as long as it is not more than the starting voltage of the fluorescent lamp 3. The lamp characteristic detection portion 8 is not limited to the configuration for detecting the operating/non-operating state of the fluorescent lamp 3, and it may detect, e.g., flickering of the fluorescent lamp 3. Since the flickering occurs as variations in the lamp current, lamp voltage, lamp power, and optical output, it can be detected easily.

In the second embodiment, the bent fluorescent lamp 51 is used. However, the present invention is not limited thereto, and other lamps, e.g., U-shaped lamps that are joined at bridge junctions may be used, as long as they are fluorescent lamps. The base 52 is not limited to the E26-type for an incandescent lamp, and other bases with different shapes may be employed. It should be noted that the present invention is not limited to the bulb-shaped fluorescent lamp having the globe 55, and it can be applied to other lamps regardless of whether they are provided with a globe.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A ballast for a discharge lamp comprising:

a discharge lamp;

an AC/DC conversion portion for converting a phase-controlled input AC voltage to a DC voltage;

a dimming control portion for calculating a dimming control signal from the phase-controlled input AC voltage; and a DC/AC conversion portion for converting an output voltage of the AC/DC conversion portion to a high frequency voltage to be applied to the discharge lamp and for lighting and dimming the discharge lamp in response to the dimming control signal, wherein the DC/AC conversion portion has a first operation mode that supplies the discharge lamp with a voltage for maintaining the lighting and a second operation mode that supplies the discharge lamp with a voltage lower than the voltage for maintaining the lighting so as to turn off the discharge lamp, and the DC/AC conversion portion switches between the first and second operation modes in response to the magnitude of the dimming control signal.

2. The ballast according to claim 1, wherein the DC/AC conversion portion switches the first and second operation modes in response to the dimming control signal.

3. The ballast according to claim 1, further comprising a lamp characteristic detection portion for detecting lamp characteristics of the discharge lamp, wherein the DC/AC conversion portion switches from the first operation mode to the second operation mode in response to an output signal of the lamp characteristic detection portion.

4. The ballast according to claim 3, wherein the lamp characteristic detection portion detects at least a factor selected from a lamp voltage, lamp current, lamp power, and optical output as the discharge lamp characteristics.

5. The ballast according to claim 1, wherein the DC/AC conversion portion performs lighting and dimming by changing a driving frequency.

6. The ballast according to claim 5, wherein f2 is greater than f1, where f1 is a maximum driving frequency of the DC/AC conversion portion in the first operation mode and f2 is a driving frequency of the DC/AC conversion portion in the second operation mode.

7. A bulb-shaped fluorescent lamp, comprising a base and the ballast according to claim 1, wherein the AC/DC conversion portion, the dimming control portion, the DC/AC conversion portion, and the discharge lamp are formed integrally.

* * * * *